United States Patent [19]

Wiik

[11] 4,423,864

[45] Jan. 3, 1984

[54] ANGULARLY ADJUSTABLE SKI DECK

[76] Inventor: Sven E. Wiik, 2883 Burgess Creek Rd., Steamboat Village, Colo. 80499

[21] Appl. No.: 310,379

[22] Filed: Oct. 13, 1981

[51] Int. Cl.[3] ..... A63B 69/18

[52] U.S. Cl. ..... 272/97; 272/69; 434/253

[58] Field of Search ..... 272/97, 69, 70, 29; 434/253; 128/25 R, 25 A

[56] References Cited

U.S. PATENT DOCUMENTS

| | | | |
|---|---|---|---|
| 2,399,915 | 5/1946 | Drake | 272/69 |
| 2,969,768 | 1/1961 | Grant | 272/69 X |
| 3,047,291 | 7/1962 | Hall | 272/56.5 |
| 3,118,315 | 1/1964 | Loosli | 272/69 X |
| 3,195,889 | 7/1965 | Hall | 272/56.5 |
| 3,222,061 | 12/1965 | Eyerly et al. | 272/29 |
| 3,408,067 | 10/1968 | Armstrong | 272/16 |
| 3,485,213 | 12/1969 | Scanlon | 272/69 X |
| 3,709,197 | 1/1973 | Moseley | 272/69 X |
| 3,814,417 | 6/1974 | Catlin | 272/56.5 |
| 3,826,491 | 7/1974 | Elder | 272/69 |
| 3,941,377 | 3/1976 | Lie | 272/57 |
| 3,961,751 | 6/1976 | Kessler | 238/10 |
| 4,023,795 | 5/1977 | Pauls | 272/97 |
| 4,074,903 | 2/1978 | Diez de Aux | 272/16 |
| 4,087,088 | 5/1978 | Kelso | 272/56.5 |

FOREIGN PATENT DOCUMENTS

| | | | |
|---|---|---|---|
| 2109203 | 2/1971 | Fed. Rep. of Germany | 272/97 |
| 2841173 | 4/1979 | Fed. Rep. of Germany | 272/69 |

*Primary Examiner*—William H. Grieb

*Attorney, Agent, or Firm*—Crandell & Polumbus

[57] ABSTRACT

An angularly adjustable ski deck is selectively downwardly or upwardly inclinable. A stand is pivotally connected to a frame, which frame rotatably supports a pair of belt rollers at either end thereof along a line transverse to the length of said frame. An endless belt is mounted around the two rollers, and is adapted to be moved in a single direction against the movement of a skier. A pair of slide tracks are formed within the belt to simulate a cross-country skiing path. Ski-on and ski-off ramps are provided at either end of the ski deck.

9 Claims, 8 Drawing Figures

ANGULARLY ADJUSTABLE SKI DECK

FIELD OF THE INVENTION

The present invention relates to devices used for amusement or for physical education training. More particularly, the present invention relates to a physical education training device related to cross-country skiing.

DESCRIPTION OF THE PRIOR ART

Devices for simulating skiing, particularly alpine skiing, have been primarily based upon the idea that the speed can be adjusted on a downwardly sloping treadmill with an upwardly moving surface so that the tendency of a skier on the surface to ski off of the surface is completely balanced by the friction imparted by the upwardly moving surface. Such an arrangement is seen in U.S. Pat. No. 4,087,088, to K. J. Kelso, wherein an energy absorbing base is used in constructing the support surface.

A variation of the treadmill concept is seen in U.S. Pat. Nos. 3,047,291 and 3,195,889, to R. L. Hall, wherein a continuously rotating circular surface replaces the treadmill. The circular surface rotates on a platform that can be angularly adjusted to vary the downward inclination of the platform.

A treadmill type simulated ski slope that only tilts downward is seen in German Pat. No. 2,109,203, to H. Wagner. Wagner shows how both the angle of inclination of the belt and the speed of the belt can be varied to give a realistic experience of actually skiing.

A downwardly only sloping platform, in which the platform is tiltable in two planes, is seen in U.S. Pat. No. 4,074,903, to A. D. de Aux. The ski boots of the user of the invention are connected by a roller assembly to the platform, which roller assembly allows the user to simulate the movements of actual skiing as the platform tilts. The sloping platform actually moves to simulate a given ski slope.

In a treadmill device similar to Wagner, discussed above, U.S. Pat. No. 3,814,417, to W. P. Catlin, shows a treadmill skiing device that is capable of being raised at one end, to thereby change the angle of the slope. Again, no positive angles relative to horizontal can be achieved to simulate an uphill slope.

U.S. Pat. No. 3,408,067, to R. E. Armstrong, shows two parallel belts used on a simulated skiing device. The two belts are not used to simulate the track of a cross-country skiing path. Rather, the belts are spaced apart so that a central pivotal post may pass between the two driven belts and attach to the skiis of the user of the device. The entire platform is downwardly tiltable, as well as tiltable from side to side.

A cross-country skiing path, that is formed of a plurality of links joined together in a chain, is seen in U.S. Pat. No. 3,961,751, to J. Kessler. The Kessler device would simply be laid over the desired terrain, and the terrain would actually be traversed on skiis utilizing the skiing path.

Devices particularly adapted to cross-country skiing simulation are seen in U.S. Pat. No. 3,941,377, to H. Lie, and U.S. Pat. No. 4,023,795, to E. A. Pauls. The Lie patent shows a stationary device in which a pair of foot plates are worn by the user, not actual cross-country skiis. The foot plates are, in turn, connected to an endless belt, which applies adjustable resistance to the movement of the user's legs. The foot plate rests upon two roller sets, one for each foot, which roller sets each have a longitudinal slot to allow the foot plate to be connected to the endless belt.

The patent to Pauls allows the user to utilize actual cross-country skiis and a roller device, which stores energy in a flywheel, to simulate the backward thrust and glide motion used in cross-country skiing.

Neither of the patents to Pauls or Lie show a cross-country skiing exercise device that can be used to simulate uphill or downhill conditions often encountered in cross-country skiing. None of the treadmill devices used to simulate skiing, discussed above, suggest the possibility of incorporating a simulated cross-country skiing path into the treadmill for purposes of simulating cross-country skiing conditions, as opposed to downhill skiing conditions.

No prior art device for simulating skiing is adapted to be towed behind an automobile or other vehicle. The very nature of these simulating devices makes this a particularly valuable feature. Often, a primary use for such devices is in teaching demonstrations. To allow a device to remain in a single location only, greatly inhibits the number of people to which the device can be exposed. The more people to which skiing is exposed, the more people who will be interested in learning cross-country skiing.

OBJECTS AND SUMMARY OF THE INVENTION

The principal object of the present invention is to provide a ski simulation device for physical training.

A related object of the present invention is to provide a ski simulation device particularly suited for cross-country skiing.

A further related object of the present invention is to provide a ski simulation device that is selectively adjustable to up and down angles relative to horizontal.

Still a further related object of the present invention is to provide a ski simulation device which includes a cross-country skiing path incorporated therein.

A further object of the present invention is to provide a ski simulation device that can be transported easily from location to location.

In accordance with the objects of the invention, an angularly adjustable ski deck is provided. The ski deck includes a stand or fulcrum which is pivotally connected to a frame. The frame includes two belt rollers extending transversely to the length of the frame and supporting thereon an endless belt. A motor and transmission drive one of the belt rollers to provide continuous movement of the continuous belt in one direction. The other of the belt rollers is slidable along the length of the frame to adjust the tension in the belt.

The stand and frame are each pivotally interconnected by hydraulic cylinders and shock absorbers. Extending one of the hydraulic cylinders tilts the entire ski deck into a downwardly inclined position relative to horizontal. Extending the other of the hydraulic cylinders pivots the frame about the stand so that the ski deck is upwardly inclined relative to horizontal.

The belt includes three endless belt segments interconnected by a pair of sliding tracks. The tracks are defined by a relatively low friction surface. In connecting the tracks to the segments, a rope or cord is placed between a segment and a track. The rope or cord is secured in relative position by an elongated piece of binding cloth placed over both sides of the entire length of the rope and joined to both the track and the segment. A track of the invention having a raised portion along either side thereof, defined by the rope or the cord, is ideally suited for simulating a cross-country skiing path.

The entire ski deck can be transported by removing a ski-on and ski-off ramp and placing them on top of the ski deck, removing the stand and storing it on top of the ski deck, and attaching a pair of wheels interconnected by an axle to the frame. A trailer tongue is then attached to one end of the frame, and the entire assembly is ready for easy transport.

DESCRIPTION OF THE PREFERRED EMBODIMENT

Figure 1:
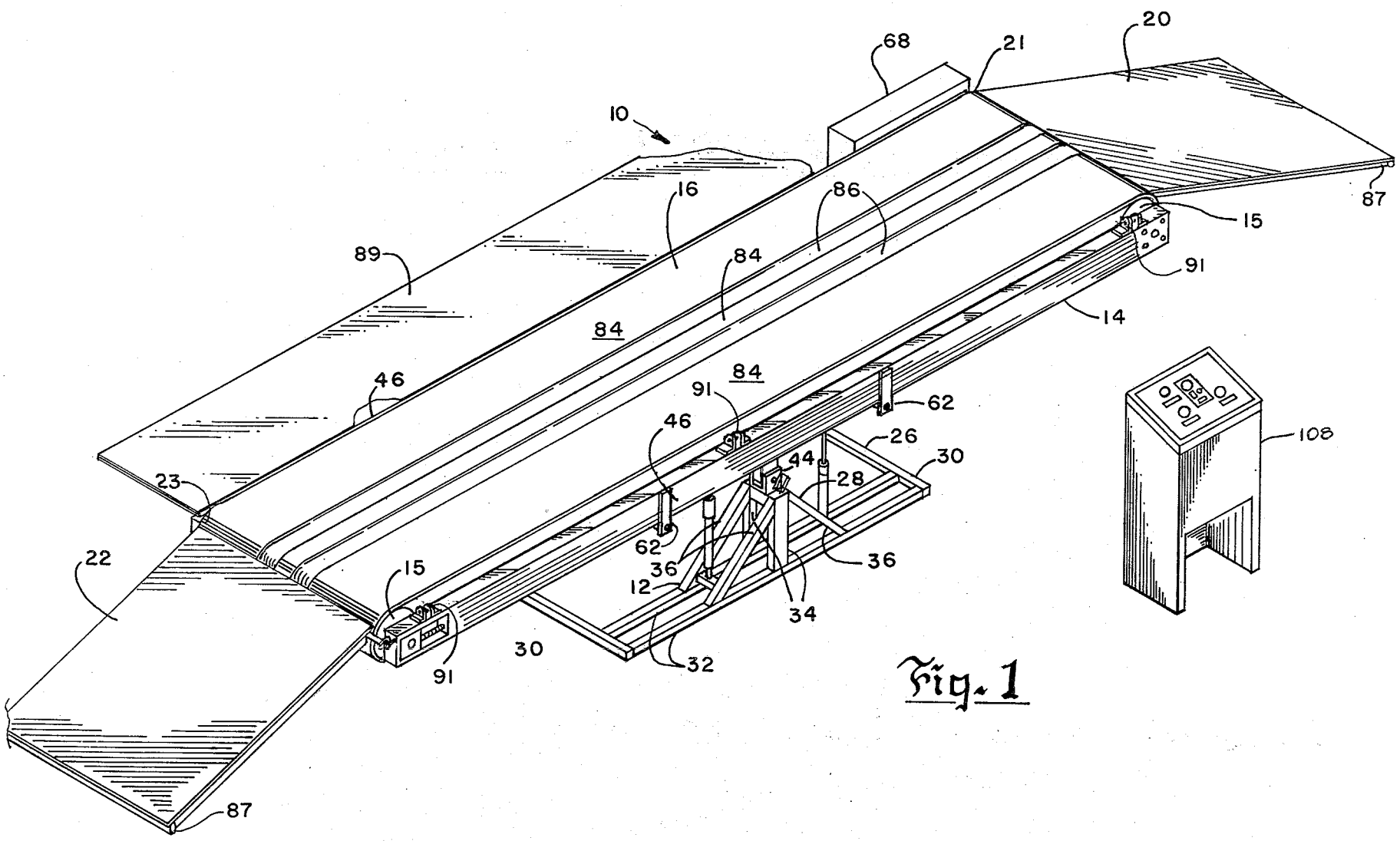
FIG. 1 is a perspective view of the angularly adjustable ski deck of the invention.
Figure 8:
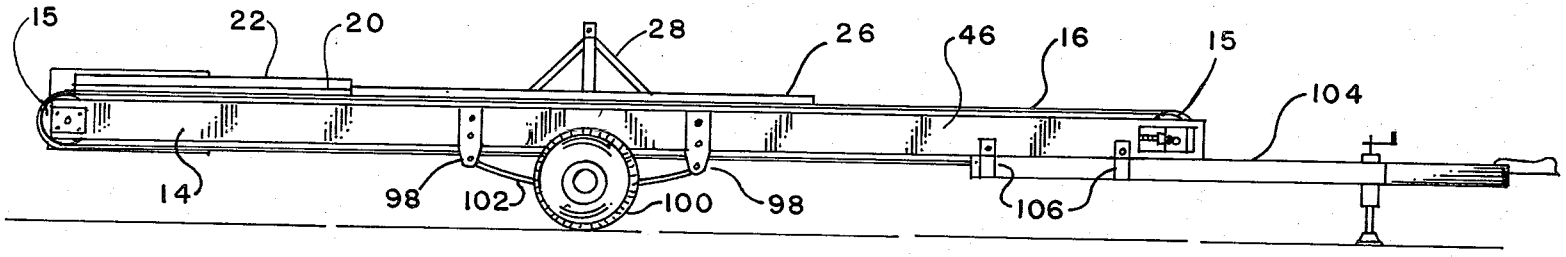
FIG. 8 is a side elevational view of the invention shown in FIG. 1 converted for transport from location to location.

An angularly adjustable ski deck 10 for simulating skiing is seen in FIG. 1 to include a stand or fulcrum 12 pivotally connected to either side of an elongated rectangular frame 14. The frame 14 includes a pair of belt rollers 15 rotatably mounted transverse to the length of the frame across either end thereof. The belt rollers 15 support an elongated endless belt 16, which belt moves continuously in one direction against the movement of a skier 18 (FIG. 2), resulting, in desired conditions, in a zero velocity of the skier relative to the frame 14. In other words, the belt 16 moves at a selected speed so that the skier 18 appears stationary while skiing or moving relative to the belt. A ski-on ramp 20 is hingeably connected to a rear end 21 of the ski deck 10, while a ski-off ramp 22 is hingeably connected to a front end 23 of the ski deck, providing for an essentially continuous skiing surface onto and off of the ski deck, respectively. The entire ski deck 10 is selectively inclined to a downward, level, or upward orientation relative to horizontal, to simulate the terrain a cross-country skier 18 might encounter. Though the present invention is usable with either downhill or cross-country skiing, this description will discuss its use in connection with cross-country skiing only. The entire ski deck can be partially disassembled and made into a transportable vehicle adapted to be towed behind an automobile or other vehicle (FIG. 8).

The stand or fulcrum 12 (FIGS. 1 and 2) is preferably of tubular steel construction, and includes a rectangular base 26, which base 26 rests on a floor of an indoor building or facility, or on the ground when used outdoors, and a pair of upright supports 28 which are pivotally connected to the frame 14, in a manner to be discussed hereinafter. The base 26 has a lateral member 30 at each end extending transverse to the direction of movement of the belt 16. Two pairs of relatively longer longitudinal members 32 are rigidly connected, as by welding, between the lateral members 30. Each pair of longitudinal members 32 are grouped to one side or the other of the base 26.

Each upright support 28 is rigidly joined to a pair of the longitudinal members 32 through a pair of vertical members 34 and four inclined members 36. The two inclined members 36 connect to the top of either side of one of the vertical members 34, and at the other end to one of the longitudinal members 32. One vertical member 34 is connected to the midpoint of each longitudinal member. A cross tie 38 (FIG. 3) rigidly connects a pair of vertical members 34, each of which is joined to the longitudinal members 32, together at the tops. The cross tie 38 is formed from a length of steel tubing 40 and an upper surface steel bearing plate 42.

Each of the stands or fulcrums 12 has a pair of spaced upright ears 44 rigidly connected to the bearing plate 42. Each ear has a hole (not shown) formed therein in alignment with the hole in the other ear connected to the bearing plate 42. The common axis of generation of the holes in the ears 44 defines a line transverse to the direction of movement of the belt 16. The ears 44 are also formed of steel plate, and will be seen to cooperate in pivotally connecting the stand 12 to the frame 14.

The frame 14 includes a relatively large, compared to the tubing used in the fulcrum 12, cross section of rectangular tubing forming a side frame member 46 for each side of the frame 14. The front end 23 of the side member has the two side portions cut out, leaving two forwardly projecting lengths 47 of the frame member 46. An upper and lower adjustment track **48*a* and 48*b* respectively (FIGS. 5 and 6) are joined, as by welding, to the projections of the frame member 46. A cap 50 rigidly connects the furthest extension of the frame member 46 and the tracks 48*a* and 48*b***.

A roller coupling 52 has a harness 53, used for a purpose to be discussed later, with upper and lower grooves **51*a* and 51*b* which receive upper and lower tracks 48*a* and 48*b* for longitudinal sliding movement therealong. The coupling 52 rotatably supports an axle 54 of the front end roller 15. The rear end roller 15 is conventionally mounted across the rear end 21** of the frame.

The couplings 52 at the front end 23 of the ski deck 10 are utilized to move the front end roller 15 away from the rear end roller, and thereby increase or decrease the tension in the endless belt 16. To accomplish this movement, a tension adjustment screw 56 is connected to a nut 57, which nut and screw are fixed to the harness 53 of the coupling 52. The other end of the screw is threadably received by a nut 58, which nut 58 can be rotated against a fixed surface 59. Rotation of the nut 58 therefore moves the screw and attached coupling along the tracks **48*a* and 48*b*, and the associated front roller 15 moves either toward or away from the rear end roller 15**.

Figure 7:
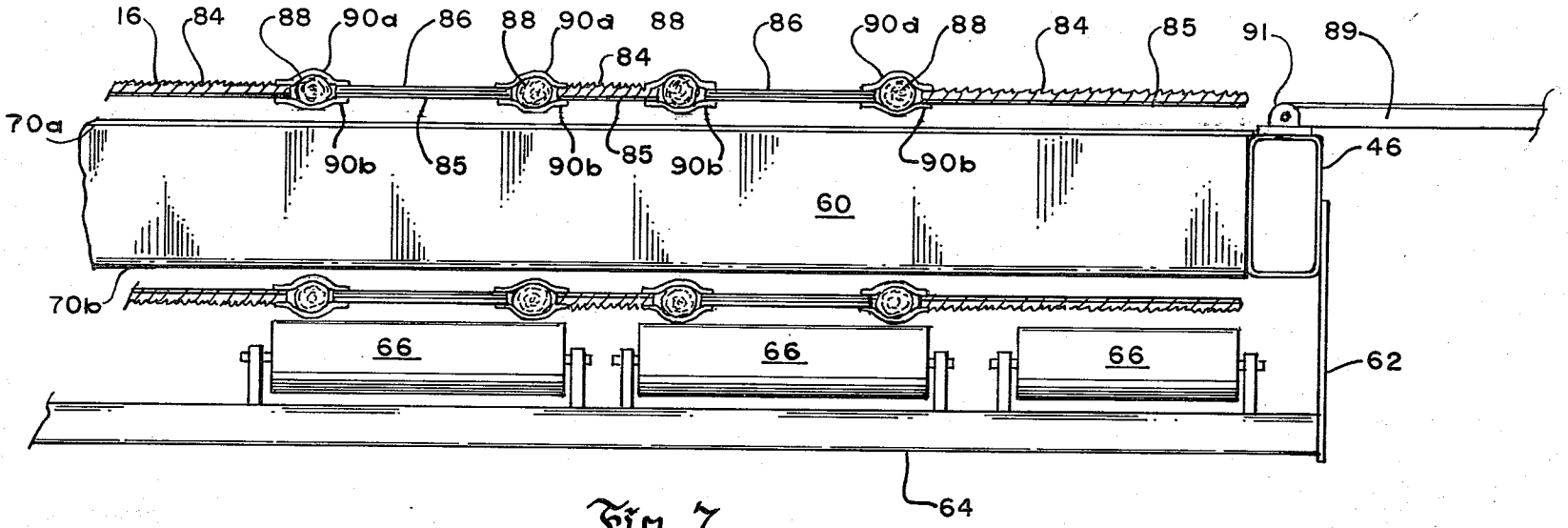
FIG. 7 is a fragmentary sectional view taken on the plane of line 7—7 of FIG. 2.

Four steel tubing cross members 60, one of which is seen in FIG. 7, connect the two side members 46 at generally equidistant positions along the length of the frame 14. The cross members at the front end 23 and rear end 21 form the frame lateral support for the belt rollers 15. The middle two cross members 60 intersect the side members 46 at a location where an idler roller hanger 62, constructed of steel plate, is rigidly connected to the outside of the side members 46. A pair of idler roller hangers 62, one for each side member 46, are interconnected by an idler roller support 64 (FIG. 7), formed of steel tubing, which roller support 64 supports four idler rollers 66 across the width of and below the belt 16 as the belt passes beneath the frame 14. The idler rollers 66 keep the belt 16 from sagging and stretching, due to its own weight. The rollers 66 are suspended a preselected distance below the belt 16 so that the belt cannot sag beyond the rollers 66. This structure keeps the belt from interfering with the motive means for pivoting the frame 14.

Upper and lower steel trays 70*a* and 70*b* respectively are connected, as by welding, to the cross members 60. The upper tray 70*a* covers substantially the length and width of the frame 14. The lower tray 70*b* covers only a short length of the frame 14.

A motor and transmission (not shown) are enclosed within a safety enclosure 68 to drive the rear end belt roller 15. The motor and transmission are connected, as by bolts, to one of the side frame members 46. As will be discussed hereinafter, the motor is a variable speed type that can be remotely controlled.

Figure 3:
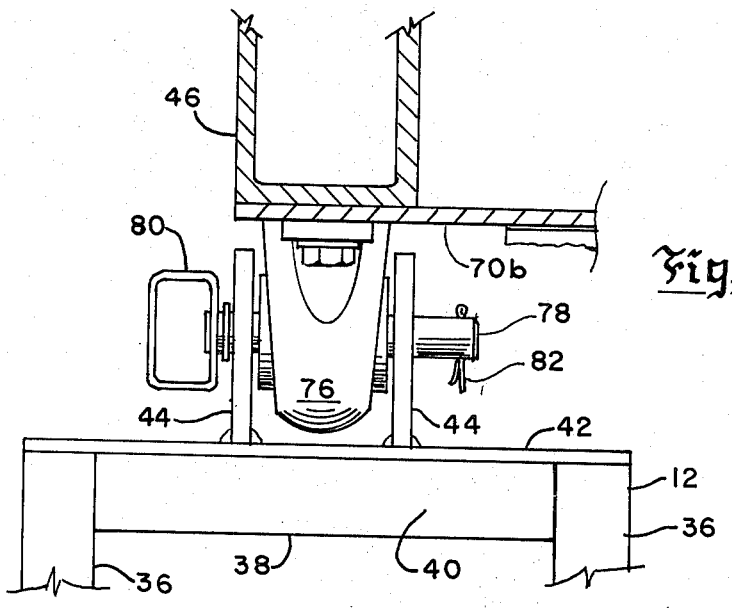
FIG. 3 is a sectional view taken in the plane of line 3—3 of FIG. 4.
Figure 4:
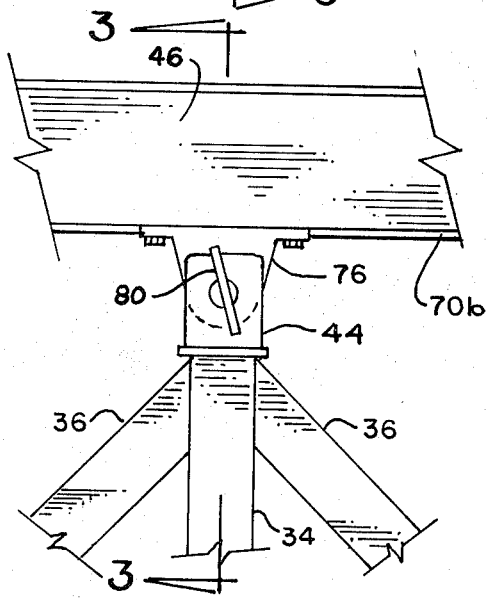
FIG. 4 is an enlarged fragmentary side elevational view of a pivotal connection between a support and a frame of the invention seen in FIG. 1.

The fulcrum 12 is pivotally connected to the frame 14, as seen in FIGS. 1, 3, and 4. A pivot 76, having a side elevation of generally semi-circular shape, has a bore therethrough for receipt of a pin 78. The pivot is bolted to the lower tray 70*b* and side member 46 at the longitudinal center of the frame 14. The pin 78 has a handhold 80 which is used to pass the pin through the hole in the ears 44 and the bore in the pivot. The pivot is positioned between a pair of spaced ears 44 on one side of the frame 14. A cotter pin 82 is inserted through the end of the pin 78 to prevent accidental withdrawal of the pin 78.

Each side of the ski deck 10 includes a hydraulic piston 79 and shock absorber 81 connected to an inclined member 36 of the stand 12 and releasably and pivotally connected to the side frame member of the frame 14 on either side of the pivot 76 in a conventional manner. The positions of the hydraulic cylinders and shock absorbers relative to the pivot are reversed when one side of the frame 14 is compared to the other side. If it is desired to downwardly incline the entire ski deck 10, one of the hydraulic cylinders is actuated, while, if upward inclination is desired, the other hydraulic cylinder is actuated. A hydraulic motor and tank 83 supply hydraulic fluid under pressure to the hydraulic piston 79 through hydraulic lines 77.

The belt 16 consists of three parallel endless belt segments 84 separated by and connected to two parallel slide tracks 86 (FIGS. 1 and 7). The segments 84 are made of nylon pile carpet having upright fibers, such as is made under the trademark "ANSO IV" by Allied Chemical Company, joined to a woven nylon backing 85. The middle segment 84 is relatively narrow, compared to the outer segments 84, so that the tracks 86 can correspond to a simulated cross-country ski track used by the skier 18. The slide tracks are also made of a woven nylon, which minimizes the friction and the possibility of suction occuring between the skiis and the track.

Each of the slide tracks 86 is connected to the middle segment 84 and one outer segment 84, as seen in FIG. 7. A nylon or other fiber cord or rope 88 is placed along the entire length of the junction between a segment and a track, defining a boundary for the ski path. A narrow elongated canvas strip or binding 90*a* covers the top surface of the cord, and is sewn to the track and adjacent segment. In a like manner, the bottom surface of the cord is covered by binding 90*b*, which binding 90*b* is sewn to the segment and track.

As will be appreciated, the rope or cord 88 establishes a line of demarcation between the track 86 and segment 84, therefore defining a track such as is typical in a cross-country skiing course.

The ski-on ramp 20 and ski-off ramp 22 are relatively thin structures of rectangular plan view. The ramps are both covered with foam padding and a carpet, such as is used in forming the segments 84. Each ramp 20 and 21 includes a wheel or roller 87 connected at one end thereof, providing for ease of movement of the ramps as the inclination of the ski deck 10 is changed.

Figure 5:
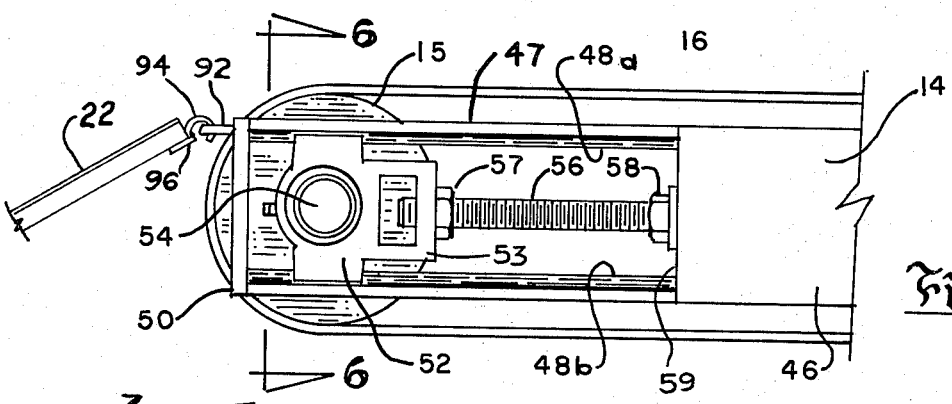
FIG. 5 is an enlarged fragmentary side elevational view of a front end of the invention shown in FIG. 1.
Figure 6:
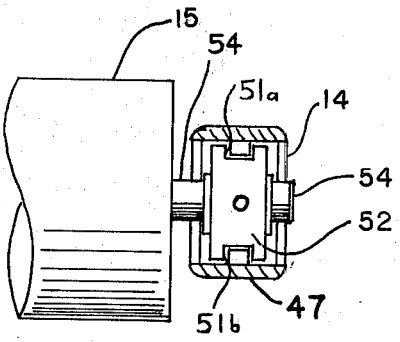
FIG. 6 is a fragmentary sectional view taken in the plane of line 6—6 of FIG. 5.

The ramps 20 and 22 are connected to the frame 14 by an eyelet 92, one mounted at each of the four corners of the frame 14, each of which eyelets receive a hook 94 (FIG. 5). The hook 94 is inserted into the eyelet, and is rigidly connected to a steel lead piece 96 traversing the edge of the respective ramp adjacent to the belt 16. The lead piece is covered by carpet so that the skier can ski over it on or off the belt 16.

Side platforms 89 (FIG. 7) are releasably connected to each side frame member 46 at releasable connections 91. The side platforms 89 are both heavily padded and covered with the same type of carpet that covers the ramps 20 and 21. The platforms 89 are a safety feature, in the event a skier 18 would fall sideways from the ski deck 10.

The ski deck 10 is transportable behind an automobile or other vehicle (not shown), as seen in FIG. 8. The ramps 20 and 22 and side platforms 89 are removed and placed on the upper surface of the belt 16. The stand 12, pistons 79, and shock absorbers are released from the frame 14 and also stored on the belt. A pair of wheel mounting brackets 98 are attached, as by bolts, to and depend from each side frame member 46. A wheel and axle assembly 100 includes an integral leaf spring 102 at each end thereof, which is adapted to be bolted to the brackets 98. A tongue assembly 104, made of tubular steel, is bolted to the side frame members 46 through tongue brackets 106 adapted to be connected to each of the side frame members 46. The hydraulic tank 83 and hose 77 can easily be stored in the trunk of a conventional automobile or truck to complete the transportation process.

Figure 2:
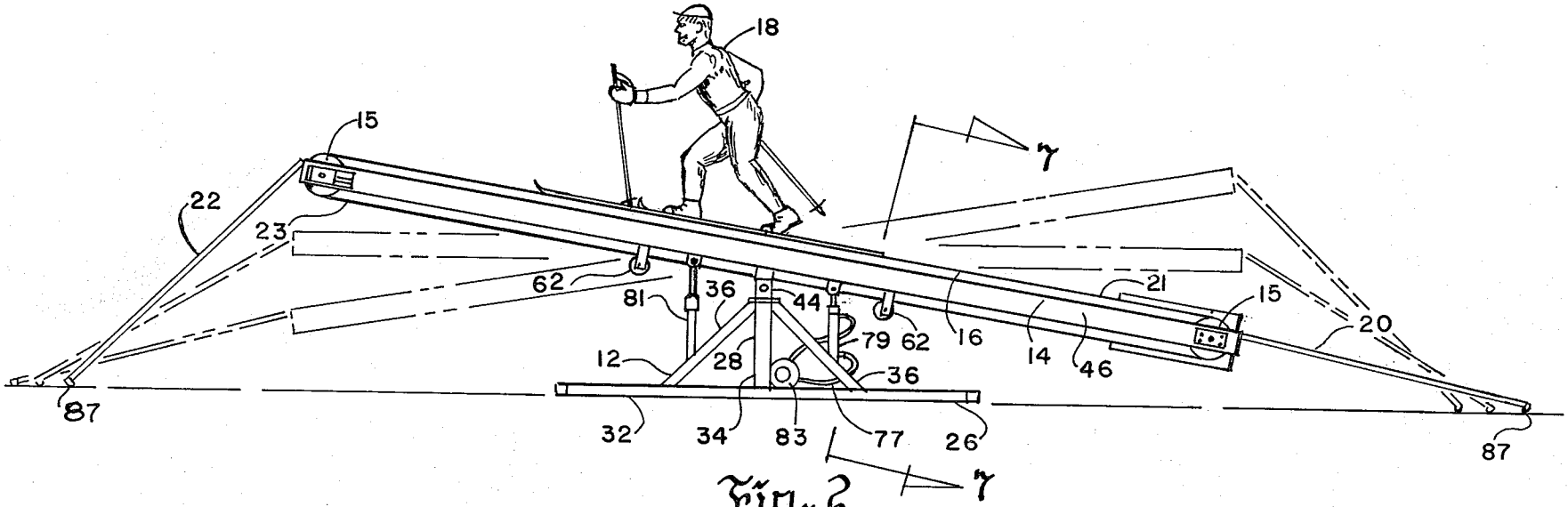
FIG. 2 is a side elevational view of the invention shown in FIG. 1 in an upwardly inclined position, with horizontal and downwardly inclined positions being shown in phantom lines.

Operation of the ski deck is governed by a control box 108 adapted to remotely control the hydraulic motor 83 and the motor driving the rear end belt roller 15 (FIG. 1) through wiring (not shown). Referring to FIG. 2, it will be seen that the entire ski deck 10 can be placed in a downwardly inclined position relative to horizontal, a level position, an upwardly inclined position relative to horizontal, or any angular position therebetween. As illustrated in FIG. 2, the skier 18 is assuming a position for uphill cross-country skiing. The belt 16 is moving against the apparent direction of movement of the skier, or in a clockwise direction, as viewed in FIG. 2.

It will be understood that, as the ski deck is lowered from the upwardly inclined position of FIG. 2 toward a level position, the speed of the belt 16 can be increased to offset the natural tendency of the skier to move faster on a horizontal surface. As the ski deck 10 is further lowered to a downwardly inclined position relative to horizontal, the speed of the belt 16 would normally be increased, so that the skier 18 can maintain the same level of exertion. The velocity of the belt, at any inclination, may be increased for increased cross-country skiing performance, as well as to establish increased heart rate and changes in other physical parameters, of the skier.

The motor is of the adjustable speed type, and the velocity of the belt 16 can, therefore, be varied between zero and as much as ten kilometers per hour. The ability to regulate the speed and inclination of the belt 16 means that a given cross-country skiing course can be simulated by manual control or by programmable controls (not shown). For any given speed of the belt 16, the time in which to cover a known distance can be calculated. The ski deck 10 can be set at that speed, at an angle corresponding to the actual course terrain, and held in that position until the next change in terrain is encountered. If the skier 18 is desiring to increase his performance, the belt speed can be increased and the corresponding time decreased, as the athlete's performance improves.

For purposes of safety, the skier 18 is provided with a switch to stop the belt 16 from moving. The switch can be in the form of a safety belt, as shown in U.S. Pat. No. 3,408,067 to R. E. Armstrong, or be based on the principal of a photoelectric beam and eye (not shown) placed across the rear end 21 and front end 23 of the ski deck 10. Breaking the beam would shut off the motor.

It will be apparent that, while a particular embodiment has been illustrated and described, various modifications and changes may be made without departing from the spirit and scope of the invention.

What is claimed is:

1. An apparatus for simulating skiing and terrain encountered during skiing, comprising:

support means resting on a support surface;

an elongated frame having belt rollers rotatably mounted transverse thereto, said elongated frame pivotally connected to said support means to provide selective angular positioning of said frame between downwardly inclined and upwardly inclined positions corresponding to said terrain;

motive means pivotally connected to said frame adapted to pivotally move said frame relative to said support means;

an endless belt mounted around said belt rollers, said belt having two parallel slide tracks formed therein for simulating a ski track; and means for rotating said belt about said belt rollers and for varying the velocity of said belt rollers and said belt dependent on the angular position of said frame.

2. An apparatus for simulating skiing comprising:

support means resting on a support surface;

an elongated frame having belt rollers rotatably mounted transverse thereto, said elongated frame pivotally connected to said support means to provide selective angular positioning of said frame between downwardly inclined and upwardly inclined positions;

motive means pivotally connected to said frame adapted to pivotally move said frame relative to said support means;

an endless belt mounted around said belt rollers, said belt having two parallel slide tracks formed therein for simulating a ski track;

a ramp hingeably connected to said frame at either end of said frame defining an essentially continuous ski surface with said endless belt; and means for rotating said belt rollers and said belt mounted thereto.

3. The invention defined in claim 2, further including means for allowing the unconnected end of said ramp to freely move on said support surface.

4. The invention defined in claim 2, wherein said segments are formed of a backing material, said backing material joined to a material having flexible fibers extending from the surface.

5. The invention defined in claim 2, wherein said frame has at least one pair of hangers rigidly connected to and depending from each side of said frame to a position below said endless belt, each said pair of hangers rotatably mounting at least one idler roller along a line transverse to the length of said frame, said idler roller maintaining a preselected position below said endless belt.

6. The invention defined in claim 2, further including side platforms extending laterally away from said frame.

7. An apparatus for simulating skiing, comprising:

support means resting on a support surface;

an elongated frame having belt rollers rotatably mounted transverse thereto, said elongated frame pivotally connected to said support means to provide selective angular positioning of said frame between downwardly inclined and upwardly inclined positions;

motive means pivotally connected to said frame adapted to pivotally move said frame relative to said support means;

an endless belt mounted around said belt rollers, said belt having three longitudinal segments, each longitudinal segment connected to at least one adjacent segment by a relatively narrow track, said connection between said track and said longitudinal segments including an upper surface covering and a lower surface covering having an elongated flexible cord of substantially the same length as said endless belt therebetween, said elongated flexible cord of generally circular transverse cross section to the length of said cord, said upper and lower coverings being connected along each side edge thereof to one of said longitudinal segments; and means for rotating said belt rollers.

8. The invention defined in claim 7 wherein said frame has an upper flat rigid underlying surface connected thereto and extending substantially over the length of said frame, said underlying surface positioned beneath said endless belt.

9. The invention defined in claim 8 wherein said underlying surface is a rigid metal tray.

* * * * *